US007055909B2

(12) United States Patent
Wu

(10) Patent No.: US 7,055,909 B2
(45) Date of Patent: Jun. 6, 2006

(54) STRUCTURE OF A CHAIR PILLOW

(75) Inventor: Yu-Ling Wu, Tainan Hsien (TW)

(73) Assignee: Comfordy Co., Ltd., Tainan Hsien (TW)

( * ) Notice: Subject to any disclaimer, the term of this patent is extended or adjusted under 35 U.S.C. 154(b) by 68 days.

(21) Appl. No.: 10/872,358

(22) Filed: Jun. 22, 2004

(65) Prior Publication Data

US 2006/0033375 A1 Feb. 16, 2006

(51) Int. Cl.
*A47C 1/10* (2006.01)

(52) U.S. Cl. ..... 297/408; 297/391; 297/396

(58) Field of Classification Search ..... 297/399, 297/397, 408, 405, 391; 403/97, 92
See application file for complete search history.

(56) References Cited

U.S. PATENT DOCUMENTS 2,869,622 A * 1/1959 Petersen et al. ..... 297/396
3,761,128 A * 9/1973 Schenk et al. ..... 297/408
3,784,253 A * 1/1974 Kohler et al. ..... 297/410
4,351,563 A * 9/1982 Hattori ..... 297/408
4,778,218 A * 10/1988 Suman ..... 297/391
5,135,283 A * 8/1992 Cassese et al. ..... 297/397
5,669,668 A * 9/1997 Leuchtmann ..... 297/408
5,967,613 A * 10/1999 McKeever ..... 297/397
6,082,817 A * 7/2000 Muller ..... 297/216.12
6,607,242 B1 * 8/2003 Estrada et al. ..... 297/216.12
6,612,653 B1 * 9/2003 Takata ..... 297/408
6,688,697 B1 * 2/2004 Baumann et al. ..... 297/391
6,805,411 B1 * 10/2004 Gramss et al. ..... 297/408
6,811,223 B1 * 11/2004 Ito ..... 297/408
6,857,704 B1 * 2/2005 Stenzel et al. ..... 297/408

* cited by examiner

*Primary Examiner*—Peter M. Cuomo
*Assistant Examiner*—Erika Garrett
(74) *Attorney, Agent, or Firm*—Rosenberg, Klein & Lee

(57) ABSTRACT

A chair pillow includes a secured member fixed on a top of a back of a chair, an intermediate member, and a pillow body; the intermediate member is pivoted to the secured member at a first end thereof such that it is normally held in position by the secured member, and can be forced to change orientation relative to the secured member; the pillow body is pivoted to a second end of the intermediate member at a rearwards projecting portion thereof such that it is normally held in position by the intermediate member, and can be forced to change orientation relative to the intermediate member; therefore, the pillow body can be adjusted in position as well as in the orientation relative to the back.

6 Claims, 7 Drawing Sheets

STRUCTURE OF A CHAIR PILLOW

BACKGROUND OF THE INVENTION

1. Field of the Invention

The present invention relates to a chair pillow, more particularly one, which can be adjusted in position and in the orientation relative to the back; the pillow includes a pillow body, an intermediate member, to which the pillow body is pivoted, and a secured member secured on a top of the back, to which the intermediate member is pivoted.

2. Brief Description of the Prior Art

It is very common for chairs of cars to have pillows fitted thereto. And now, a kind of office chairs are available that are equipped with pillows for supporting the heads of the sitters on.

However, earlier pillows of office chairs are fixed in position, incapable of being adjusted in the height and position to suit different sitters. And, some sitters who are too tall or too short in their body heights have to change their posture to rest their heads on the pillows. Consequently, the sitters will have sore backs and necks.

Referring to FIG. 1, another conventional chair pillow includes two support rods secured on top of the chair back at lower ends, a connecting plate secured on a rear side of a main body of the pillow, two opposing wings projecting from the connecting plate, and a pivotal tube secured to upper ends of the support rods and passed into the holes of the wings; thus, the main body of the pillow can change in the angle relative to the chair back. This chair pillow still isn't ideal because it can't be forwards and rearwards displaced or up and down displaced relative to the back, and some sitters who are too tall or too short in their body heights still have to change their posture to rest their heads on the pillow. Furthermore, the chair will be more difficult to assemble, and the pillow can't be removed if necessary because the chair back has the support rods secured thereon for the pillow main body.

SUMMARY

It is a main object of the present invention to provide a chair pillow, which can be adjusted in position and orientation relative to the back, to overcome the above disadvantages.

The chair pillow of the present invention includes a secured member fixed on a top of a back of a chair, an intermediate member, and a pillow body. The intermediate member is pivoted to the secured member at a first end thereof such that it is normally held in position by the secured member, and can be forced to change orientation relative to the secured member. The pillow body is pivoted to a second end of the intermediate member at a rearwards projecting portion thereof such that it is normally held in position by the intermediate member, and can be forced to change orientation relative to the intermediate member. Thus, the pillow body can be adjusted in position as well as in the orientation relative to the back.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
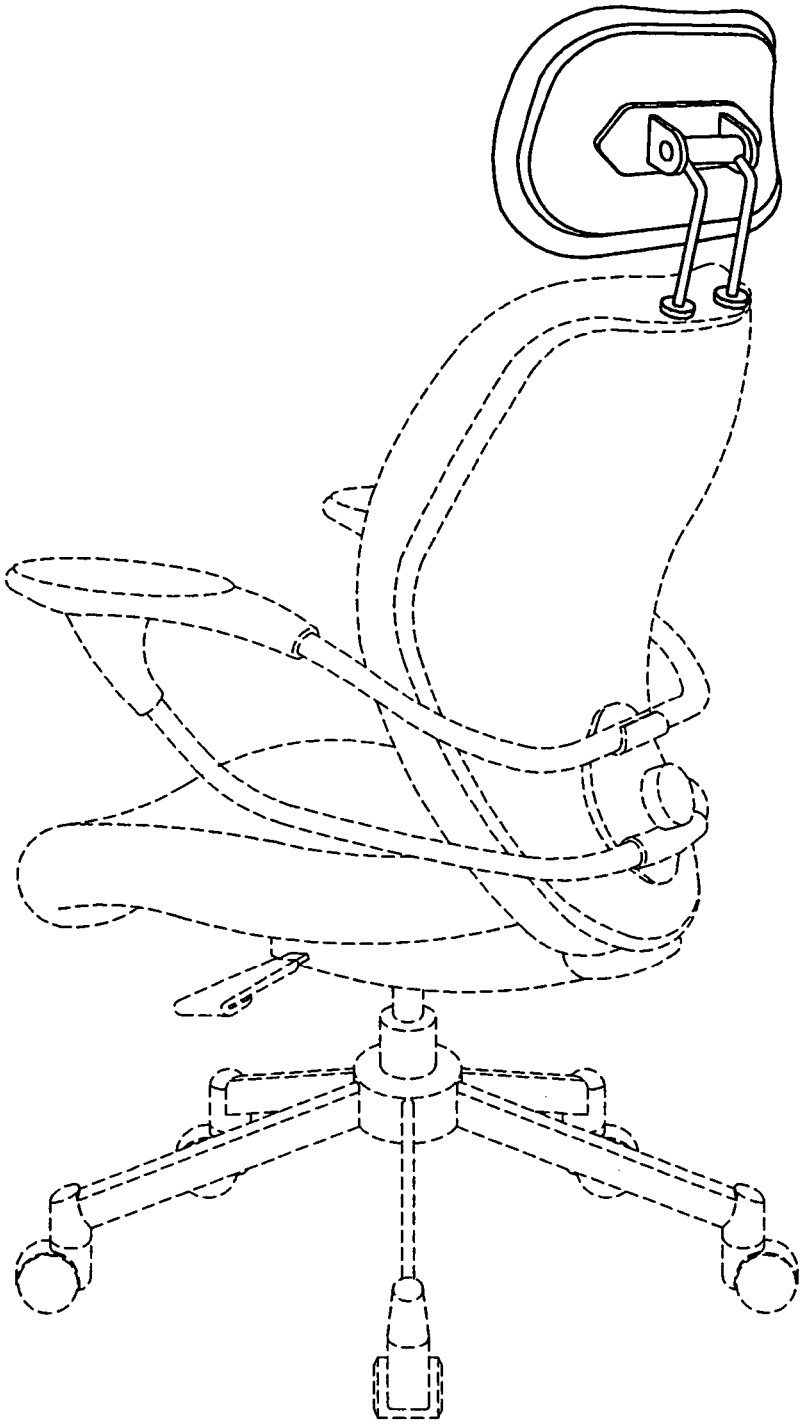
FIG. 1 (PRIOR ART)
FIG. 1 is a perspective view of the chair with the conventional pillow.
Figure 2:
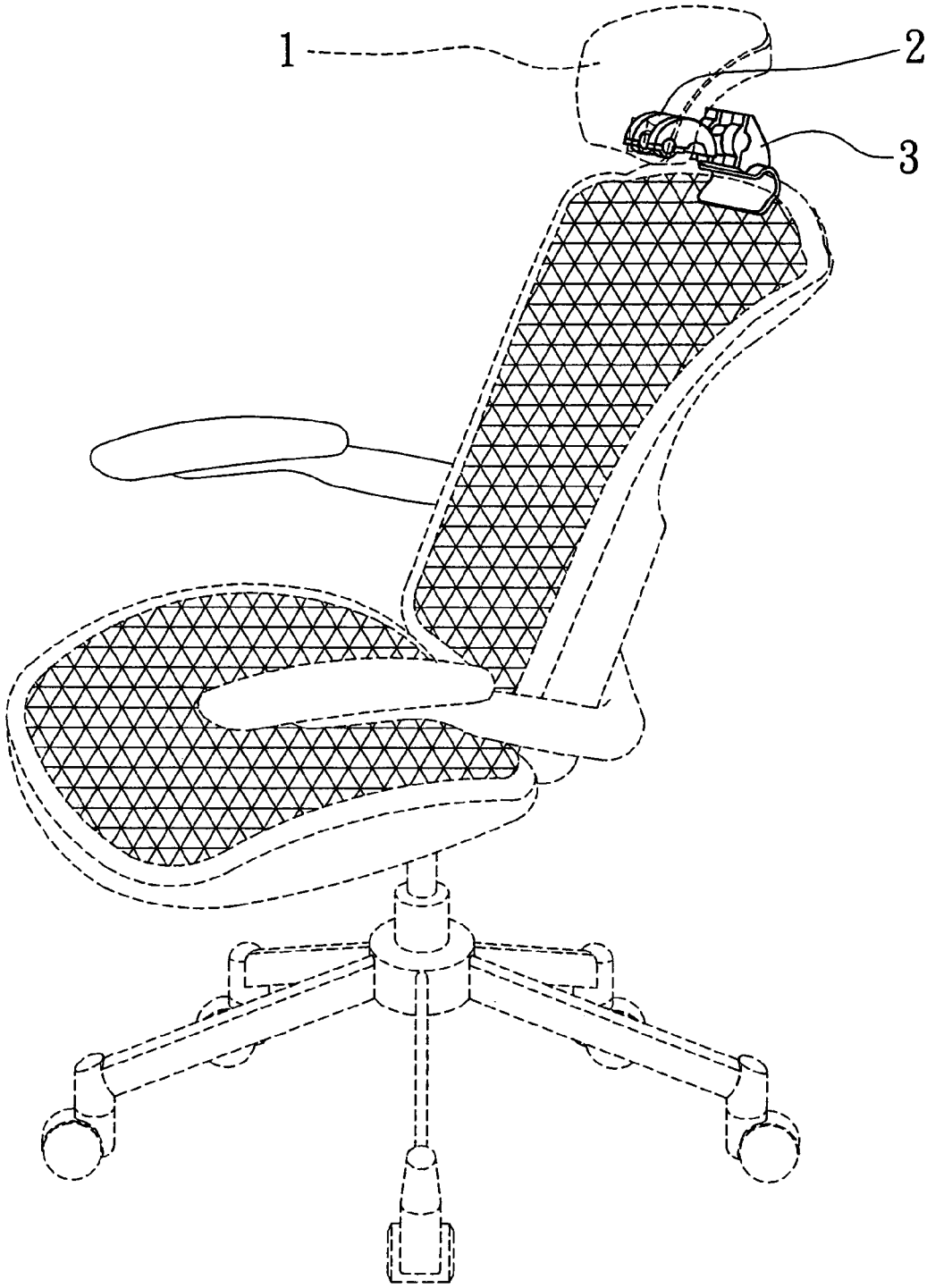
FIG. 2 is a perspective view of the chair with the pillow of the present invention.
Figure 3:
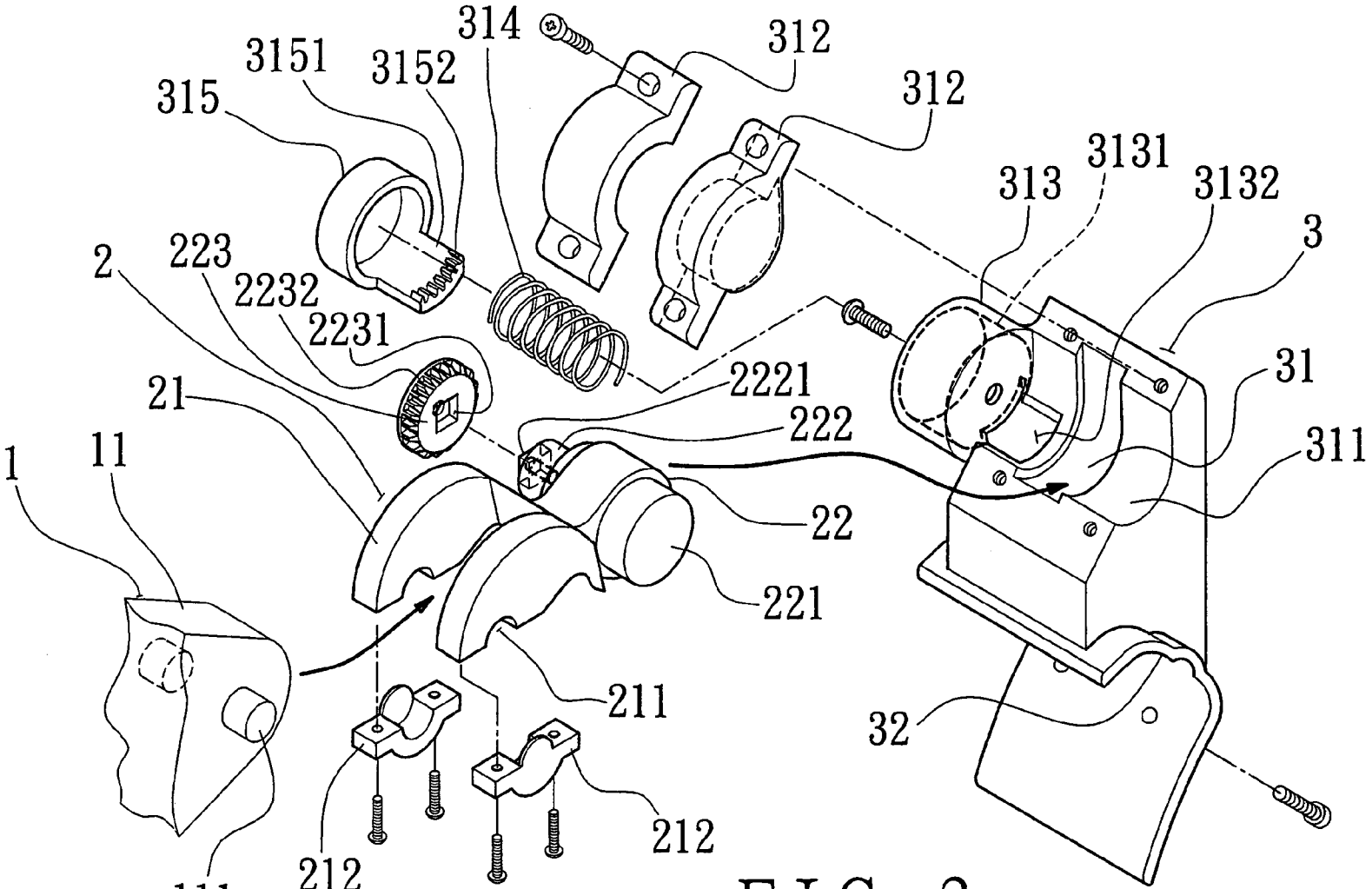
FIG. 3 is a partial exploded perspective view of the chair pillow of the present invention.

Referring to FIGS. 2 and 3, a preferred embodiment of a chair pillow of the present invention includes a pillow member 1, a first locating member 2, and a second locating member 3.

The pillow member 1 has a main support portion (not numbered), and a fitting portion 11, which projects from a rear side of the main support portion, and has pivotal posts 111 on two sides thereof.

The first locating member 2 has a fitting portion 21 at one end, and a connecting portion 22 at the other end. The fitting portion 21 has two spaced lateral walls whose edges are formed with semicircular cavities 211. In addition, two covers 212, each of which has a semicircular cavity, are secured to respective ones of the spaced lateral walls of the fitting portion 21 with the semicircular cavities thereof facing the semicircular cavities 211. The connecting portion 22 has a pivotal post 221 projecting from a lateral side, a second post 222 projecting from the other lateral side, and a fitting block 2221 on the second post 22. Furthermore, a pivotal toothed ring 223 is provided, which has a fitting recess 2231 on a middle portion, a central through hole, and teeth spaced apart on an outer side thereof, between which fitting spaces 2232 are formed. The pivotal toothed ring 223 is fitted onto the fitting block 2221 at the fitting recess 2231 thereof, and a bolt is screwed used to connect the pivotal ring 223 to the fitting block 2221; thus, the ring 223 can't be angularly displaced relative to the fitting block 2221.

The second locating member 3 has a connecting portion 31 at an upper end, and a forked securing portion 32 at a lower end, which has two parts. The connecting portion 31 has a first semicircular cavity 311 on an upper side thereof, a second semicircular cavity deeper than, and next to the cavity 311, a third semicircular cavity next to the second one, a tube-shaped portion 313 adjacent to the third semicircular cavity, and a guide trench 3132 on the third semicircular cavity; the tube-shaped portion 313 has a holding room 3131 therein.

Two covers 312, each of which has a semicircular cavity on a lower side, are secured on the connecting portion 31 with the semicircular cavities thereof facing the first and the third semicircular cavities of the connecting portion 31 respectively. Furthermore, the third locating member 3 has a button 315 fitted thereto, which has a main body, an extension portion 3151 projecting from one end of the main body, and engaging teeth 3152 spaced apart on the extension portion 3151. The button 315 is passed into the holding room 3131 of the tube-shaped portion 313 with the extension portion 3151 being held in the guide trench 3132, and an elastic element 314 is positioned in the holding room 3131 to contact an inner side of the button 315; thus, the button 315 is biased outwardly of the tube-shaped portion 313 by the elastic element 314, and can only be linearly displaced relative to the tube-shaped portion 313.

Figure 4:
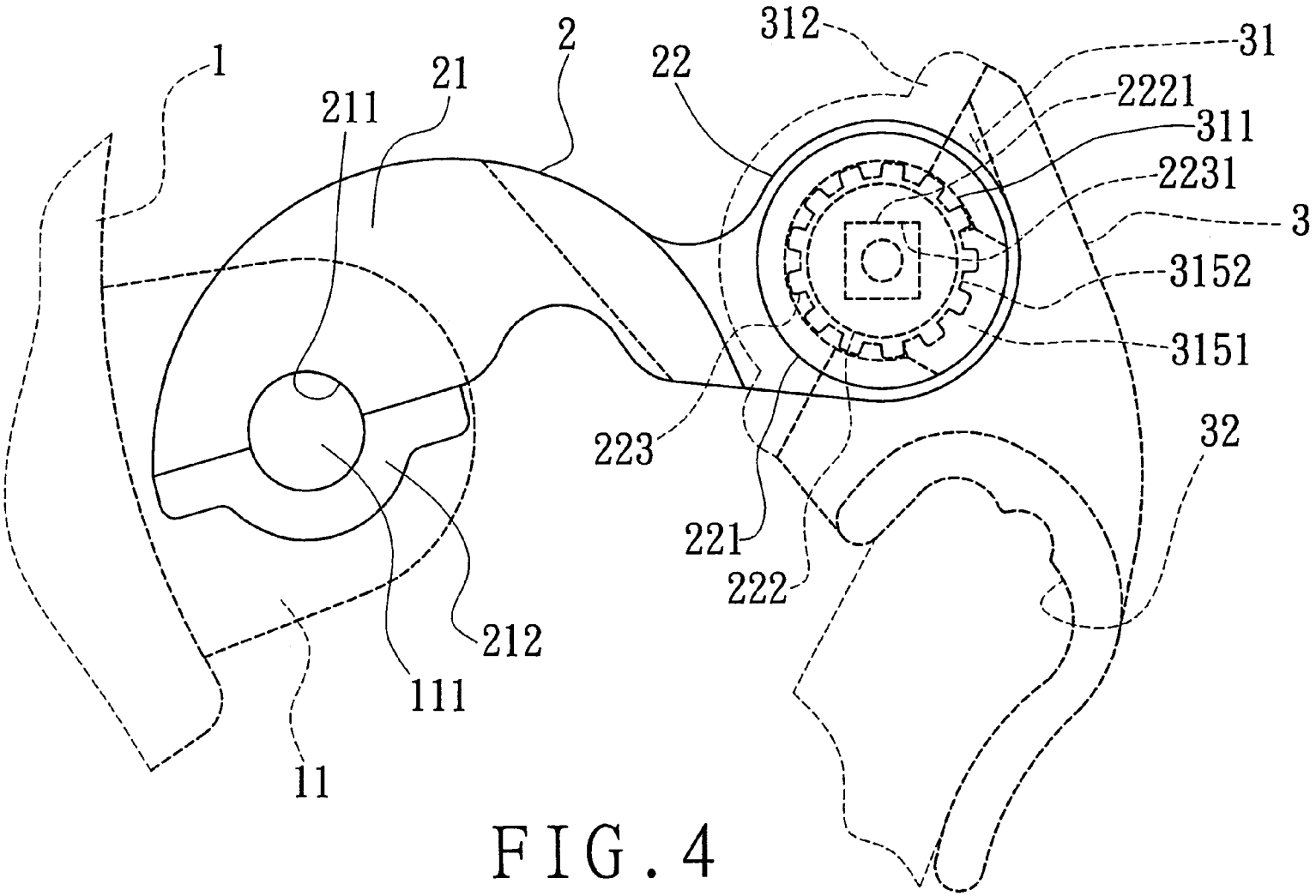
FIG. 4 is a partial side view of the pillow of the present invention.

The second locating member 3 is positioned over, and securely connected with an upper end of a back of a chair with the two parts of the forked securing portion 32 respectively touching front and rear sides of the chair back, as shown in FIGS. 2 and 4.

Figure 5:
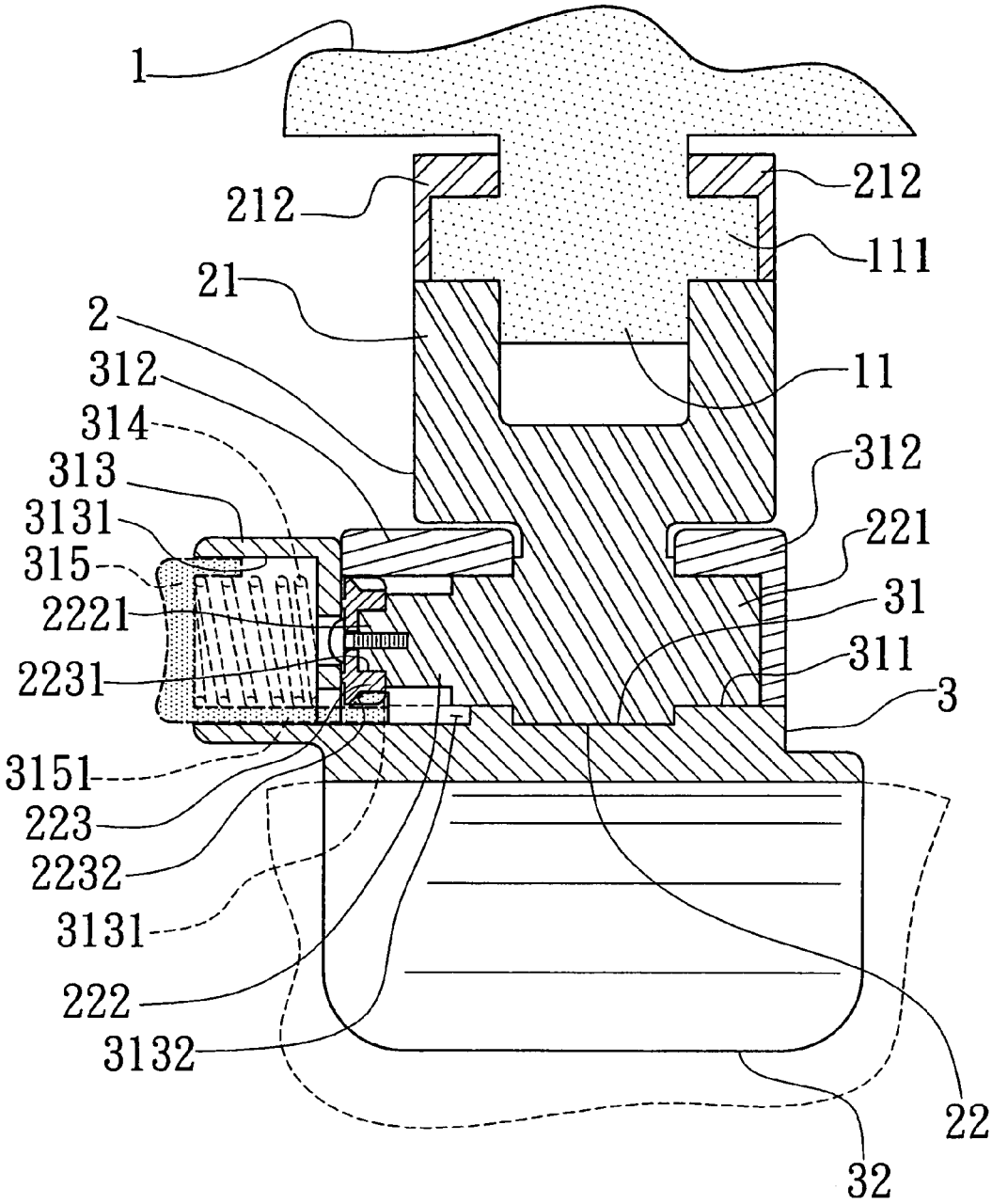
FIG. 5 is a cross-sectional view of the present pillow.
Figure 6:
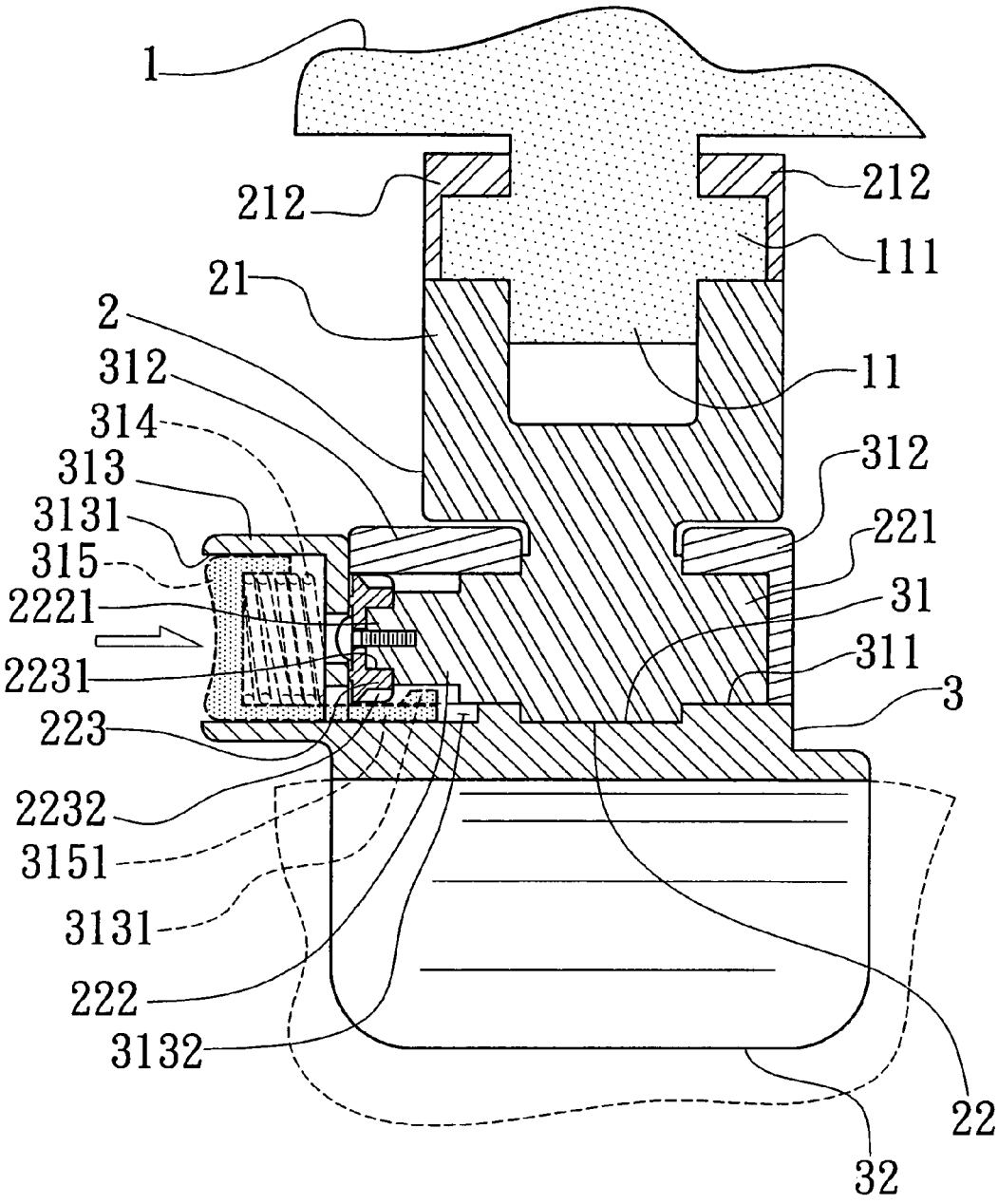
FIG. 6 is a cross-sectional view of the present pillow in adjustment.

To assemble the present pillow, first the pillow member 1 is fitted in the fitting portion 21 of the second locating member 2 at the fitting portion 11 thereof with the pivotal posts 111 being respectively held in the semicircular cavities 211, and the covers 212 are secured in position in the way mentioned above; thus, the pillow member 1 is pivoted to the first locating member 2, and there is such tightness between the pivotal posts 111 and the locating member 2 that the pillow member 1 won't move relative to the locating member 2 unless people force it to. Next, the first locating member 2 is fitted to the connecting portion 31 of the second locating member 3 at the connecting portion 22 thereof with the pivotal post 221 and the second post 222 thereof being respectively held in the first and the third semicircular cavities of the second locating member 3, and the covers 312 are secured in position in the way mentioned above; thus, the pivotal post 221 of the first locating member 2 is tightly held in a room, which is formed between the first semicircular cavity 311 and the corresponding cover 312, and the engaging teeth 3152 of the button 315 are normally held in the fitting spaces 2232 of the pivotal toothed ring 223 of the first locating member 2 as shown in FIG. 5, and the engaging teeth 3152 will move out of the fitting spaces 2232 as soon as the button 315 is pressed with the extension portion 3151 thereof sliding along the guide trench 3132 as shown in FIG. 6. Therefore, the first locating member 2 can be angularly displaced relative to the second locating member 3 when the button 315 is in the pressed position (FIG. 6), but it normally can't move relative to the second locating member 3.

Figure 7:
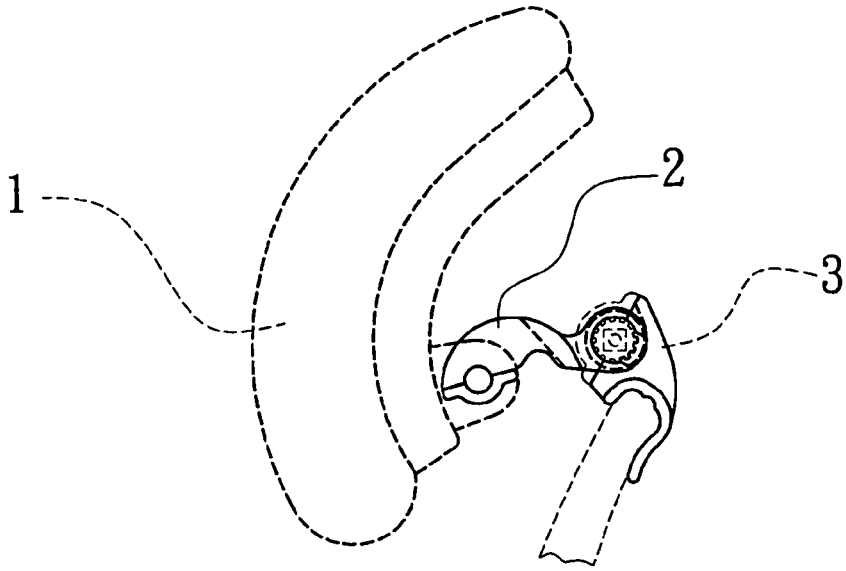
FIG. 7 is a side view of the pillow of the present invention.
Figure 8:
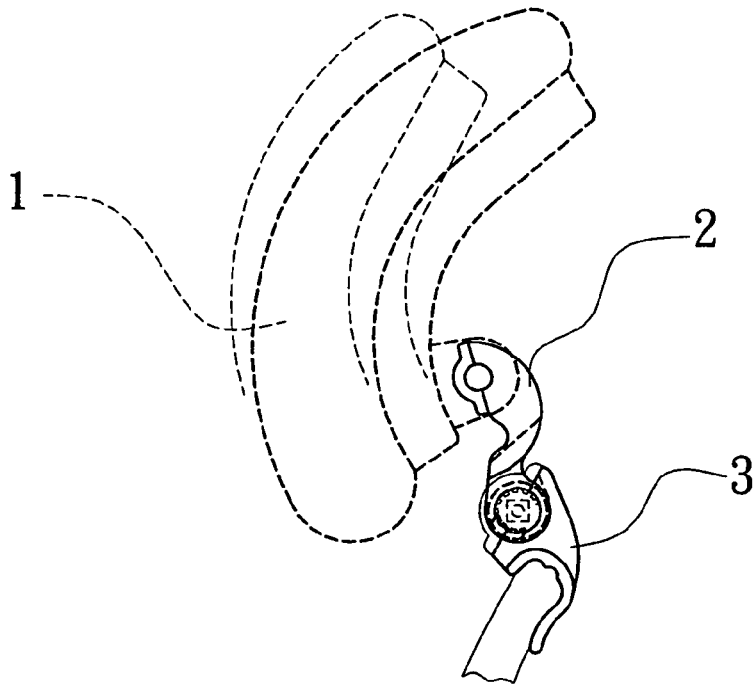
FIG. 8 is a side view of the present pillow in another position.

Therefore, referring to FIGS. 7 and 8, the height of the pillow member 1 will change when the first locating member 2 is angularly displaced relative to the second locating member 3; the pivotal toothed ring 223 will engage the engaging teeth 3152 of the button 315, and the first locating member 2 will be secured in position as soon as the user stops pressing the button 315 after adjusting the locating member 2. And, the pillow member 1 can be changed in the orientation relative to the back of the chair by means of forcing the same to pivot on the first locating member 2.

In addition, with the forked securing portion 32, the second locating member 3 can be easily detached from, and connected to the upper end of the chair back, and in turns, the present pillow can be removed from the chair if necessary.

From the above description, it can be understood that the chair pillow of the present invention can be easily adjusted in height as well as in its orientation and position relative to the chair back therefore it is more flexible than the conventional one as mentioned above, and can suit the need of different sitters.

What is claimed is:

1. A chair pillow, comprising a secured locating member fixedly connected with an upper end of a back of a chair at a lower end thereof; the locating member having a connecting portion at an upper end;

an intermediate locating member pivoted to the upper connecting portion of the secured locating member at a first end thereof such that it is normally held in position by the secured locating member, and such that it can be forced to change orientation relative to the secured locating member; and a pillow member pivoted to a second end of the intermediate locating member at a rearwards projecting fitting portion thereof such that it is normally held in position by the intermediate locating member, and such that it can be forced to change orientation relative to the intermediate locating member;

whereby the pillow member can be adjusted in position as well as in orientation relative to the back;

wherein the fitting portion of the pillow member has pivotal posts on two sides thereof, and the intermediate locating member has a fitting portion at the second end, which includes two spaced lateral walls whose edges are formed with semicircular cavities; two covers, each of which has a semicircular cavity, being secured to respective ones of the lateral walls with the semicircular cavities thereof facing respective ones of the semicircular cavities of the lateral walls; the pivotal posts of the fitting portion of the pillow member being respectively tightly held in rooms, which are formed owing to the semicircular cavities.

2. A chair pillow, comprising a secured locating member fixedly connected with an upper end of a back of a chair at a lower end thereof, the locating member having a connecting portion at an upper end;

an intermediate locating member pivoted to the upper connecting portion of the secured locating member at a first end thereof such that it is normally held in position by the secured locating member, and such that it can be forced to change orientation relative to the secured locating member; and a pillow member pivoted to a second end of the intermediate locating member at a rearwards projecting fitting portion thereof such that it is normally held in position by the intermediate locating member, and such that it can be forced to change orientation relative to the intermediate locating member;

whereby the pillow member can be adjusted in position as well as in orientation relative to the back;

wherein the upper connecting portion of the secured member has a first semicircular cavity on an upper side thereof, and the intermediate member has a connecting portion at the first end, which has a pivotal post projecting from it; a cover, which has a semicircular cavity, being secured to the upper connecting portion of the secured member with the semicircular cavity thereof facing the first semicircular cavity of the upper connecting portion; the pivotal post of the intermediate member being tightly held in a room, which is formed owing to the semicircular cavities.

3. The chair pillow as claimed in claim 2, wherein:

the upper connecting portion of the secured member has a guide trench on an upper side, and the intermediate member connecting portion has first and second posts projecting from two sides thereof;

the first post of the intermediate member being tightly held in a room formed owing to the semicircular cavities;

the intermediate member having a toothed ring, which is secured on the second post thereof to face the guide trench of the secured member; the toothed ring having a plurality of fitting spaces spaced apart on an outer side thereof;

the secured member having a tube-shaped portion next to the guide trench thereof; a button being passed into the tube-shaped portion with an extension portion thereof being held in the guide trench; the extension portion of the button having a plurality of teeth spaced apart thereon; an elastic element being connected with the button for biasing the button to a first position where the teeth are respectively held in the fitting spaces to engage the toothed ring; the teeth of the button being moveable out of the fitting spaces responsive to the button being is pressed with the extension portion thereof sliding along the guide trench;

whereby the intermediate locating member normally can be prevented from moving relative to the secured locating member, and whereby the intermediate locating member can be angularly displaced relative to the secured locating member when the button is in the pressed position.

4. A chair pillow, comprising a secured member fixedly connected with a top of a back of a chair at a lower end thereof; the locating member having a connecting portion at an upper end, which has formed a guide trench thereon;

an intermediate member having a connecting portion at a first end thereof, and first and second posts projecting from two sides of the connecting portion; the intermediate member being pivoted to the upper connecting portion of the secured member at the posts; and a pillow member connected with a second end of the intermediate member in an angularly displaceable manner;

the intermediate member having a toothed ring, which is secured on the second post thereof to face the guide trench of the secured member, the toothed ring having a plurality of fitting spaces spaced apart on an outer side thereof;

the secured member having a tube-shaped portion next to the guide trench thereof; a button being passed into the tube-shaped portion with an extension portion thereof being held in the guide trench; the extension portion of the button having a plurality of teeth spaced apart thereon; an elastic element being connected with the button for biasing the button to a first position where the teeth are respectively held in the fitting spaces to engage the toothed ring; the teeth of the button being moveable out of the fitting spaces as soon as the button is pressed with the extension portion thereof sliding along the guide trench;

whereby when the button is in a pressed position, the intermediate member can be angularly displaced relative to the secured member for the pillow member to change position relative to the back.

5. The chair pillow as claimed in claim 4, wherein the lower end of the secured member has a forked shape with two parts, and is connected to the top of the chair back with the two parts thereof respectively touching front and rear sides of the chair back.

6. The chair pillow as claimed in claim 4, wherein the upper connecting portion of the secured member has a first semicircular cavity on an upper side, and a cover, which has a semicircular cavity, is secured to the upper connecting portion of the secured member with the semicircular cavity thereof facing the first semicircular cavity; the first post of the intermediate member being held in a room formed owing to both of the semicircular cavities.

* * * * *